US007913785B2

(12) United States Patent
Korsumaki et al.

(10) Patent No.: US 7,913,785 B2
(45) Date of Patent: Mar. 29, 2011

(54) SNOWMOBILE COOLING SYSTEM

(75) Inventors: Mika Korsumaki, Rovaniemi (FI); Esa Vaisanen, Rovaniemi (FI)

(73) Assignee: BRP Finland Oy, Rovaniemi (FI)

( * ) Notice: Subject to any disclaimer, the term of this patent is extended or adjusted under 35 U.S.C. 154(b) by 308 days.

(21) Appl. No.: 12/059,489

(22) Filed: Mar. 31, 2008

(65) Prior Publication Data

US 2009/0241862 A1 Oct. 1, 2009

(51) Int. Cl.
*B60K 11/00* (2006.01)

(52) U.S. Cl. ..... 180/68.1

(58) Field of Classification Search ..... 180/68.1, 180/68.4, 190
See application file for complete search history.

(56) References Cited

U.S. PATENT DOCUMENTS 3,835,948 A * 9/1974 Duclo ..... 180/190
5,992,552 A * 11/1999 Eto ..... 180/190
6,651,765 B1 * 11/2003 Weinzierl ..... 180/190
6,681,724 B1 * 1/2004 Berg ..... 123/41.1
7,353,898 B1 4/2008 Bates
7,448,462 B2 * 11/2008 Etou ..... 180/190
2007/0193715 A1 * 8/2007 Bergman et al. ..... 165/41

* cited by examiner

*Primary Examiner* — Joanne Silbermann
*Assistant Examiner* — Daniel Yeagley
(74) *Attorney, Agent, or Firm* — Osler, Hoskin & Harcourt LLP

(57) ABSTRACT

A snowmobile is disclosed having a frame. A tunnel is formed in a rearward portion of the frame. An engine disposed on the frame. A drive track is disposed at least in part in the tunnel and is operatively connected to the engine for propulsion of the snowmobile. At least one ski is operatively connected to the frame at least in part forwardly of the drive track. A straddle seat is disposed on the frame at least in part above the drive track. A steering device is operatively connected to the at least one ski for steering the snowmobile. A radiator is disposed between the tunnel and the track. The radiator has a first side facing the track and a second side facing the tunnel. The second side is generally opposite the first side. At least a portion of the second side is spaced apart from the tunnel.

18 Claims, 13 Drawing Sheets

SNOWMOBILE COOLING SYSTEM

FIELD OF THE INVENTION

The present invention relates to a snowmobile cooling system.

BACKGROUND OF THE INVENTION

Most snowmobiles have a frame made of bent sheet metal and metal tubing. A forward portion of the frame forms an engine cradle for supporting an internal combustion engine. A rearward portion of the frame forms a tunnel generally having an inverted U-shape. A drive track is disposed at least in part in the tunnel and is driven by the engine to propel the snowmobile. The combustion of fuel in the engine produces a significant amount of heat, and some of this heat is absorbed from the engine by a coolant, such as a mixture of water and ethylene glycol, to maintain the engine at a suitable temperature. The hot coolant is then pumped to a radiator, where the heat is dissipated to the atmosphere.

Referring to FIG. 1, during operation of a snowmobile, the rotation of the track 10 inside the tunnel 14 causes cold air and snow to circulate in the tunnel 14. It is common to mount one or more radiators 16, 20, 24 at one or more positions on the inside of the tunnel 14, facing the track 10, so that the circulation of cold air and snow can be used to dissipate heat from the coolant flowing through the radiators 16, 20, 24 to cool the engine. The number of radiators and their size and positions within the tunnel 14 are dictated by the cooling requirements of the engine. The radiator 16 is positioned on the front wall 18 of the tunnel 14, the radiator 20 is positioned on the top surface 22 of the tunnel 14, and the radiator 24 is positioned on the inside of a rear portion 26 of the tunnel 14 in combination with a snow flap 28 to increase the quantity of snow that comes into contact with the radiator 24.

Referring to FIG. 2, in an alternative embodiment the radiator 30 may be constructed as part of the top surface 32 of the tunnel 34, resulting in a reduced-weight snowmobile.

Although these arrangements provide adequate cooling for the engine of the snowmobile, they have a number of disadvantages.

When the radiator is positioned on the front wall of the tunnel, the metal frame conducts heat from the radiator to the engine compartment situated forwardly of the tunnel. As a result, the temperature of the engine compartment is increased, thereby reducing the effectiveness of the radiator to cool the engine.

Regardless of where the radiator is positioned on the tunnel, heat from the radiator is transferred to the tunnel. Snow coming into contact with the warm tunnel melts and later re-freezes, resulting in ice build-up on one or more of the tunnel, the track and the rear suspension assembly. The ice build-up increases the weight of the snowmobile. In addition, water that re-freezes on the track and rear suspension assembly when the snowmobile is not in use can in some cases result in the suspension or the track becoming jammed, making the snowmobile difficult to move.

In some snowmobiles, as described above, it is necessary to provide multiple radiators, to provide adequate cooling for the engine, resulting in increased weight of the snowmobile and increased cost of manufacture.

Therefore, there is a need for a snowmobile having a radiator arrangement that provides efficient cooling of the engine of the snowmobile.

There is also a need for a snowmobile having a radiator arrangement resulting in a lightweight cooling system.

There is also a need for a snowmobile having a radiator arrangement that reduces or eliminates the likelihood of ice build-up on the components of the snowmobile.

SUMMARY OF THE INVENTION

It is an object of the present invention to ameliorate at least some of the inconveniences present in the prior art.

It is also an object of the present invention to provide a radiator spaced apart from the frame of the snowmobile.

In one aspect, the invention provides a snowmobile comprising a frame. A tunnel is formed in a rearward portion of the frame. An engine is disposed on the frame. A drive track is disposed at least in part in the tunnel. The drive track is operatively connected to the engine for propulsion of the snowmobile. At least one ski is operatively connected to the frame at least in part forwardly of the drive track. A straddle seat is disposed on the frame at least in part above the drive track. A steering device is operatively connected to the at least one ski for steering the snowmobile. A radiator is disposed between the tunnel and the track. The radiator has a first side facing the track and a second side facing the tunnel. The second side is generally opposite the first side. At least a portion of the second side is spaced apart from the tunnel.

In a further aspect, at least 25% of the second side is spaced apart from the tunnel.

In a further aspect, at least 50% of the second side is spaced apart from the tunnel.

In a further aspect, at least 75% of the second side is spaced apart from the tunnel.

In a further aspect, the entire second side is spaced apart from the tunnel.

In a further aspect, an air passage is between the second side of the radiator and the tunnel.

In a further aspect, when the snowmobile is being operated in the forward direction, the direction of air flow along the first side is opposite the direction of air flow along the second side.

In a further aspect, the radiator is disposed at least in part forwardly of the track.

In a further aspect, the tunnel has a front wall. The second side of the radiator faces the front wall of the tunnel.

In a further aspect, the second side of the radiator generally follows a contour of the front wall of the tunnel.

In a further aspect, the top wall of the tunnel has a downwardly-extending projection disposed generally rearwardly of the air passage.

In a further aspect, when the snowmobile is being operated in a forward direction, an area of reduced air pressure is created at a rearward opening of the air passage.

In a further aspect, when the snowmobile is being operated in the forward direction, the direction of air flow along the first side is opposite the direction of air flow along the second side.

In a further aspect, the first side of the radiator is generally arcuate.

In a further aspect, the track is supported by a plurality of axles. One of the plurality of axles is a forwardmost axle. The first side of the radiator forms a generally circular arc having a center of curvature approximately at an axis of rotation of the forwardmost axle.

In a further aspect, the radiator has an inlet and an outlet. The inlet and the outlet communicate with an interior of the radiator via the second side. The inlet and the outlet pass through the front wall of the tunnel.

In a further aspect, the first side of the radiator has a plurality of fins projecting outwardly therefrom in the direction of the track. The second side of the radiator has generally flat sections.

In a further aspect, the first side of the radiator has a first plurality of fins projecting outwardly therefrom in the direction of the track. The second side of the radiator has a second plurality of fins projecting outwardly therefrom.

In a further aspect, the second plurality of fins contact the tunnel.

For purposes of this application, terms relating to spatial orientation, such as "forwardly", "rearwardly" and "transversely" are defined consistently with a forward travel direction of the snowmobile.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
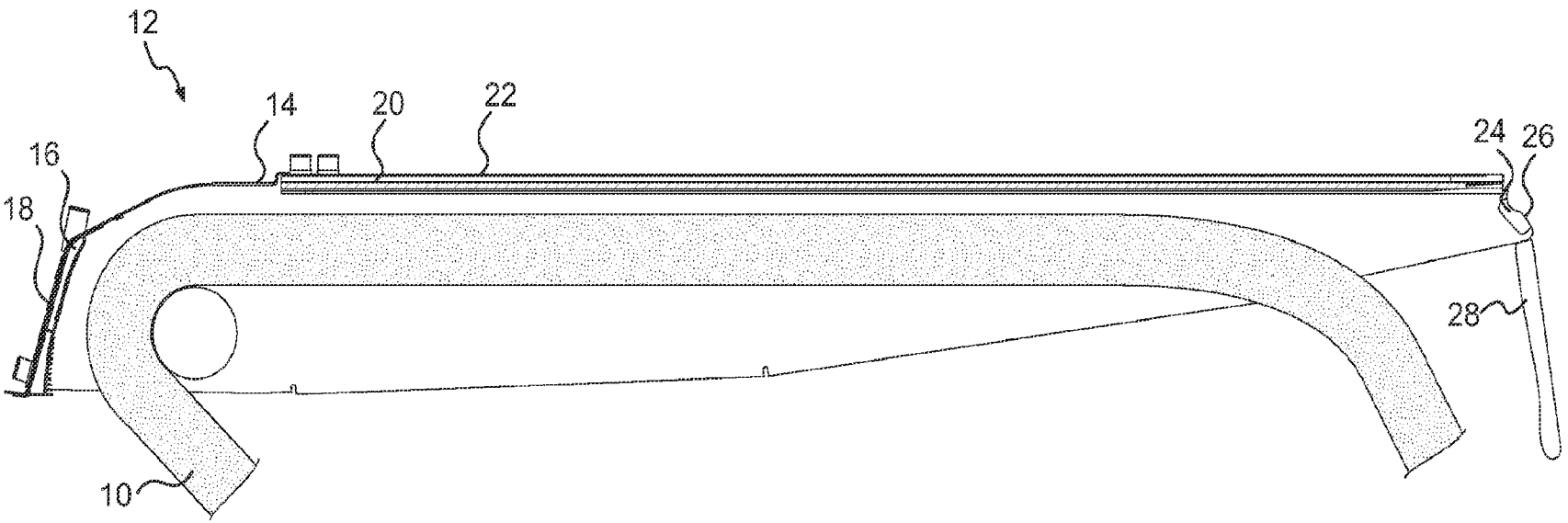
FIG. 1 PRIOR ART
FIG. 1 is a schematic cross-sectional view of a prior art snowmobile tunnel, taken along the longitudinal centerline of the tunnel.
Figure 2:
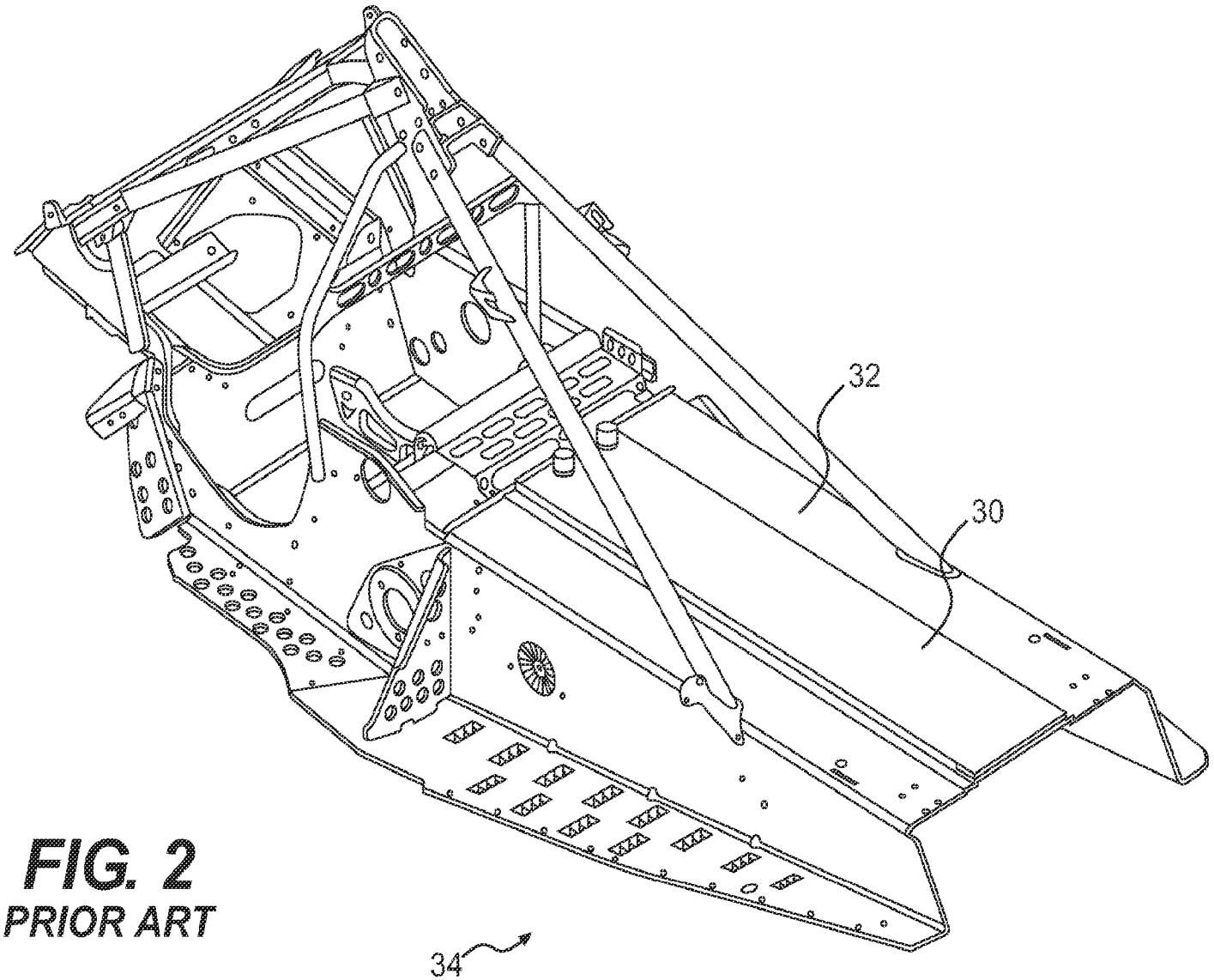
FIG. 2 PRIOR ART
FIG. 2 is a perspective view, taken from a rear, left side, of a prior art frame assembly for a snowmobile.
Figure 3:
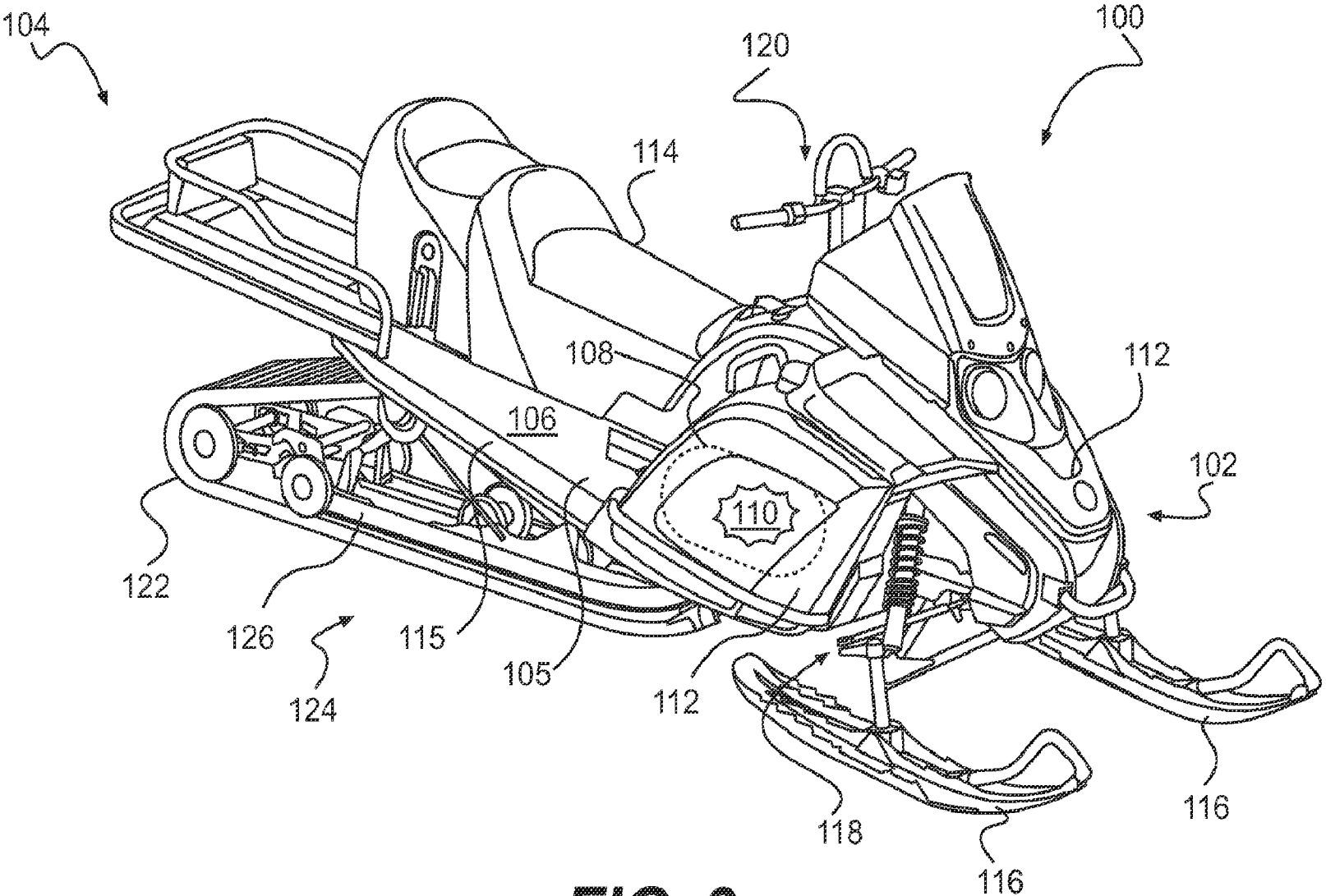
FIG. 3 is a perspective view, taken from a front, right side, of a snowmobile in accordance with aspects of the present invention.

Referring to FIG. 3, a snowmobile 100 will be described. The snowmobile 100 has a forward end 102 and a rearward end 104 which are defined consistently with a travel direction of the vehicle. The snowmobile 100 has a frame 105 including a tunnel 106 and an engine cradle 108. The tunnel 106 generally consists of one or more pieces of sheet metal bent to form an inverted U-shape. The tunnel 106 extends rearwardly along the longitudinal centerline of the snowmobile 100 and is connected at the front to the engine cradle 108. An engine 110 (schematically illustrated) is supported by the engine cradle 108. A number of fairings 112 are supported on the frame 105 to provide aesthetic appeal and to shield some components of the snowmobile 100 from the elements. A straddle seat 114 is provided above the tunnel 106 for accommodating a rider and, optionally, one or more passengers. Footrests 115 extend outwardly from the tunnel 106 to support the feet of the rider and passengers.

A pair of skis 116 at the front end 102 of the snowmobile 100 are connected to the frame via a suspension system 118. A steering assembly 120 is provided generally forwardly of the seat 114, and is connected to the skis 116 in a known manner such that turning the steering assembly 120 turns the skis 116 to steer the snowmobile 100. It should be understood that the snowmobile 100 may alternatively have only a single ski 116.

At the rear end 104 of the snowmobile 100, an endless track 122 is supported by a rear suspension system 124. The rear suspension system 124 includes a pair of slide rails 126 in sliding contact with the track 122. The upper portion of the track 122 is disposed in the tunnel 106. The track 122 is driven by the engine 110 via a transmission (not shown) to propel the snowmobile 100.

A cooling system circulates a liquid coolant through the engine 110 to absorb some of the heat generated by the combustion of fuel in the engine 110 and maintains the engine 110 at a suitable operating temperature. The coolant is then circulated to a radiator 128 (FIG. 4) that will be described below in further detail, to dissipate the heat to the atmosphere.

Figure 4:
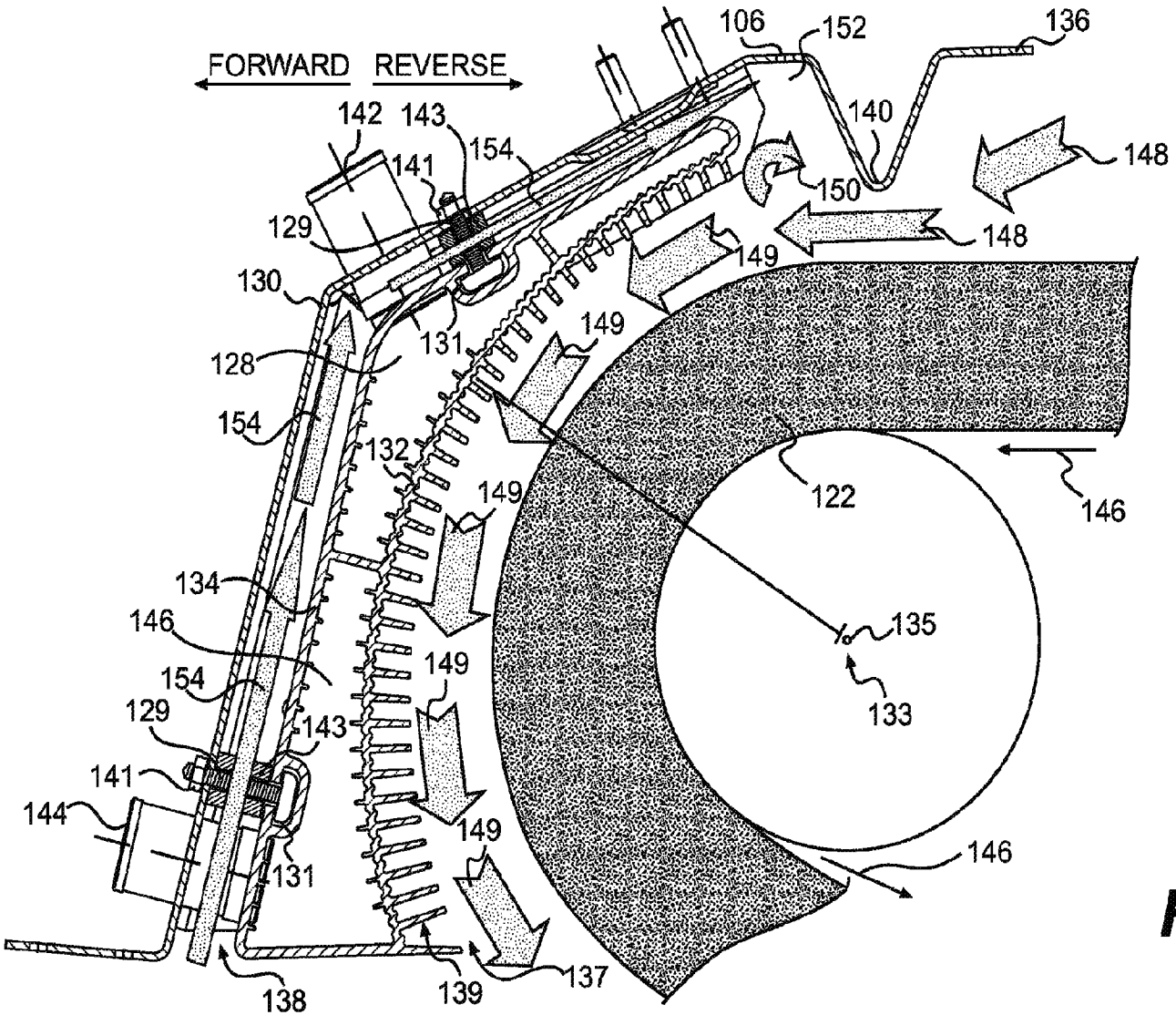
FIG. 4 is a cross-sectional view of a front portion of the tunnel and radiator of the snowmobile of FIG. 3, taken along the longitudinal centerline of the snowmobile of FIG. 3.
Figure 5:
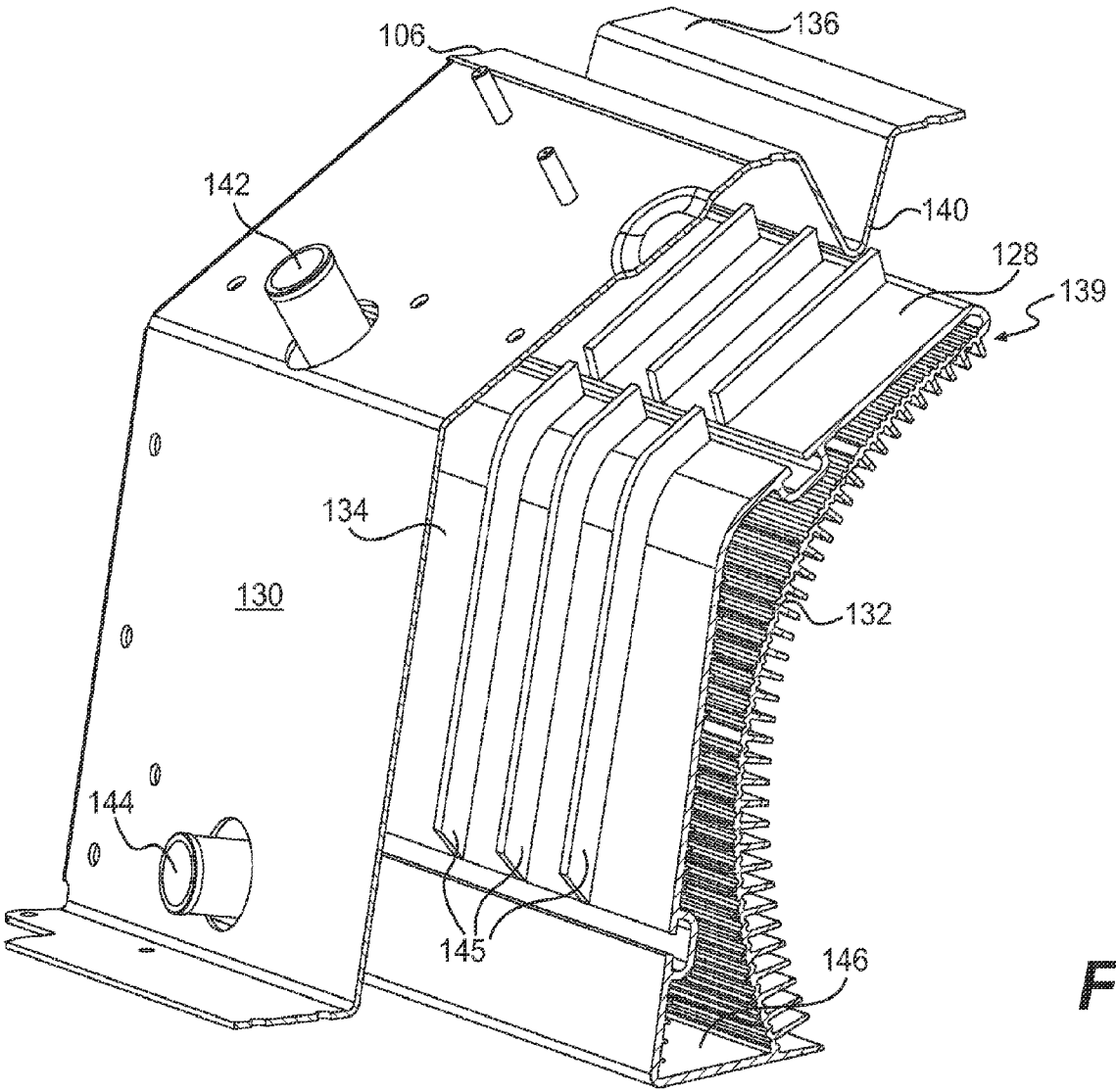
FIG. 5 is a partial cut-away perspective view of the tunnel and radiator of FIG. 4.

Referring now to FIGS. 4 and 5, the radiator 128 will be described.

The radiator 128 is mounted inside the tunnel 106, between the front wall 130 of the tunnel 106 and the track 122. The radiator 128 is held in position by fasteners 129 such as bolts inserted through the front wall 130 of the tunnel 106 and received in the recesses 131 of the radiator. Each fastener 129 is held in position by a corresponding nut 141. A spacer 143 disposed on the fastener 129 maintains the second side 134 of the radiator 128 in a position spaced apart from the front wall 130. A portion of the radiator 128 is disposed forwardly of the track 122. It is contemplated that the entire radiator 128 may be disposed forwardly of the track 122. A first side 132 of the radiator 128 faces a forward portion of the track 122. The first side 132 is generally arcuate and forms a generally circular arc with its center of curvature approximately at the axis of rotation 133 of the forwardmost axle 135 supporting the track 122, such that the first side 132 and the track 122 form an air passage 137 of approximately uniform width therebetween. A plurality of fins 139 extend outwardly from the first side 132, generally in the direction of the track 122, to provide increased thermal contact between the radiator 128 and the air passage 137.

A second side 134 of the radiator 128, generally opposite the first side 132, faces the front wall 130 of the tunnel 106 and is spaced apart therefrom. The second side 134 generally follows the contour of the front wall 130. An air passage 138 is formed in the space between the radiator 128 and the front wall 130 of the tunnel 106. The air passage 138 reduces heat transfer from the radiator 128 to the tunnel 106 and thus reduces or eliminates the likelihood of ice build-up on the frame 105. In addition, the flow of air 154 through the passage 138 contributes to cooling the second side 134 of the radiator 128 as will be discussed below in further detail. Other positions are contemplated for the radiator 128, as will be described in further detail below. It is further contemplated that a thermally insulating material may be provided between the radiator 128 and the tunnel 106 instead of, or in addition to, the air passage 138 to reduce heat transfer to the tunnel 106. The second side 134 is made of generally flat sections. It is contemplated that the second side 134 has fins 145 projecting outwardly therefrom The fins 145 are oriented generally parallel to the flow of air 154 along the second side 134, so as not to interfere with the flow of air 154. It is contemplated that the fins 145 may alternatively have a different orientation, for example the fins 145 may be oriented transversely. It is further contemplated that the fins 145 may extend far enough away from the second side 134 that they contact the front wall 130, in which case the spacers 143 may be omitted. It is further contemplated that the second side 134 may alternatively be formed of flat sections only, without the fins 145.

A downwardly-extending projection is formed in the top wall 136 of the tunnel 106, generally rearwardly of both the radiator 128 and the air passage 138. The projection 140 prevents snow or other debris from being thrown by the track 122 into the air passage 138 and obstructing the air flow therethrough. The projection 140 additionally creates an upward flow of air 154 (FIG. 4) through the air passage 138, as will be described below in further detail.

An inlet 142 and an outlet 144 of the radiator 128 pass through apertures in the front wall 130 of the tunnel 106 and allow the cooling system of the engine 110 to communicate with the interior 146 of the radiator 128 via the second side 134 of the radiator 128. Hot coolant from the engine 110 enters the interior 146 of the radiator 128 via the inlet 142 and returns to the engine 110 via the outlet 144 after it has been at least partially cooled by the radiator 128.

Referring to FIG. 4, the operation of the radiator 128 will be described. When the snowmobile 100 is being operated in the forward direction (indicated by the arrow), the engine 110 drives the track 122 to rotate in the direction 146. The rotation of the track 122 causes the circulation 148 of cold air and snow within the tunnel 106, which in turn induces the circulation 149 of cold air along the first side 132 of the radiator 128, in the direction of rotation 146 of the track 122. The cold air and snow contact the first side 132 of the radiator 128, in particular the fins 139, and absorb heat from the radiator 128, thereby cooling the coolant circulating therein. The projection 140 induces a turbulent air flow 150 in the area of the rearward opening 152 of the air passage 138. The air flow 150 creates an area of reduced pressure at the opening 152. The reduced pressure causes cold air 154 to be drawn through the air passage 138, along the second side 134 of the radiator 128 in the direction shown. The cold air 154 contacts the second side 134 of the radiator 128, and absorbs heat from the radiator 128, further cooling the coolant circulating therein. As can be seen, the circulation of cold air 154 is in the direction opposite that of the circulation 149.

Both the first side 132 and the second side 134 of the radiator 128 are used for dissipating the heat from the engine 110 to the atmosphere. As a result of the increased surface area of the radiator 128 that is used to dissipate heat to the atmosphere, the radiator 128 can provide adequate cooling for the engine 110, in some cases without the need for a second radiator, resulting in a lightweight vehicle with a compact cooling system. The absence of a second radiator along the top wall 136 of the tunnel 106 additionally reduces the likelihood of ice build-up on components disposed beneath the rear portion of the tunnel 106, such as the track 122 and the rear suspension system 124.

Figure 6:
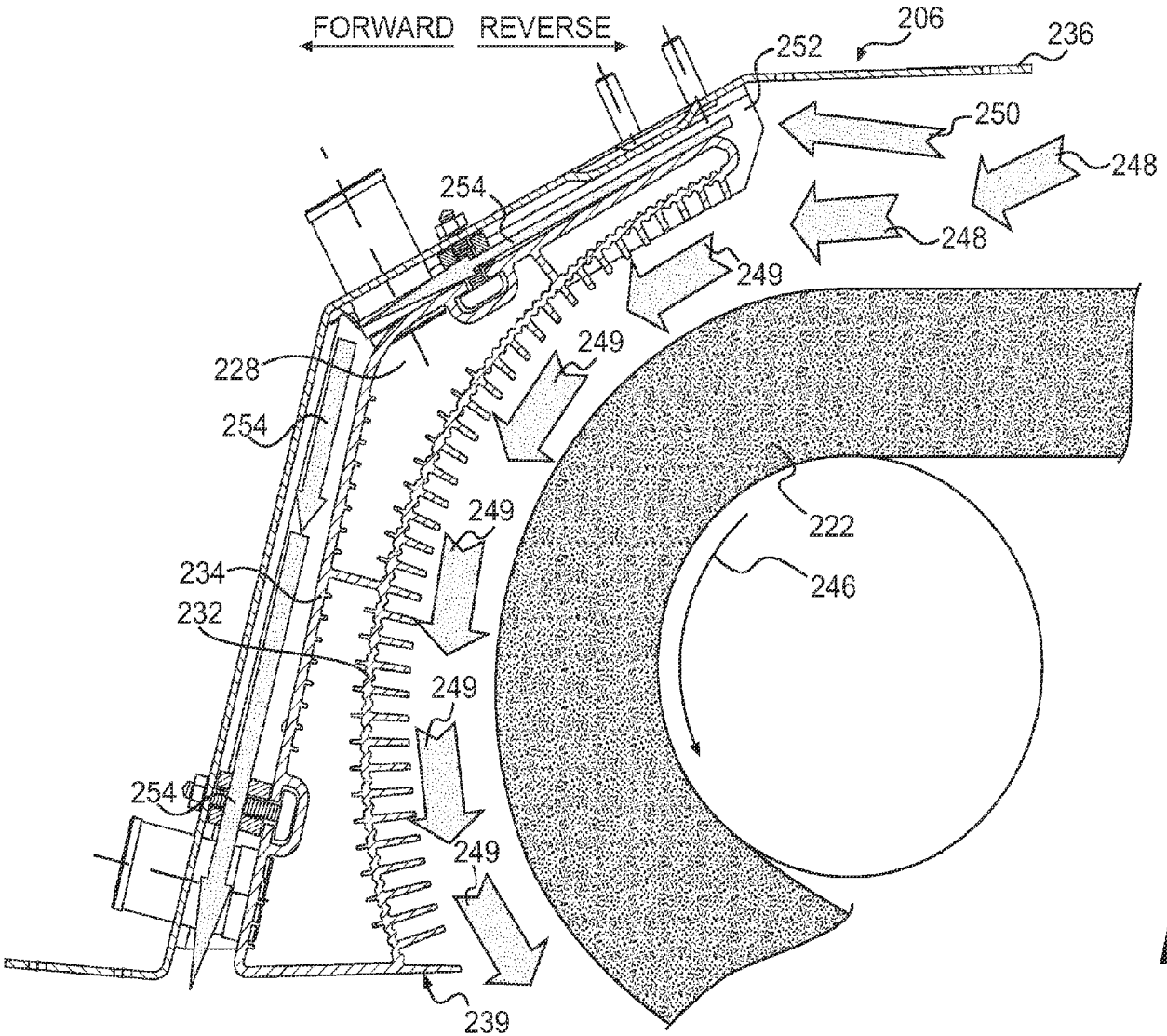
FIG. 6 is a cross-sectional view of a front portion of the tunnel and radiator of a snowmobile according to an alternative embodiment.

Referring now to FIG. 6, the operation of an alternative embodiment of a radiator 228 will be described according to a second embodiment. Where the embodiment of FIG. 6 has features similar to those shown in FIG. 4, they have been given similar reference numbers differing only in the first digit. Some features common to both embodiments are not indicated in FIG. 6 and will not be described again in detail. When the snowmobile 100 is being operated in the forward direction (indicated by the arrow), the track 222 is driven by the engine 110 to rotate in the direction 246. The rotation of the track 222 causes the circulation of cold air 248 and snow within the tunnel 206, which induces a circulation 249 of cold air and snow along the first side 232 of the radiator 228, in the direction of rotation 246 of the track 222. The cold air and snow contact the first side 232 of the radiator 228, in particular the fins 239, and absorb heat from the radiator 228, thereby cooling the coolant circulating therein. The top wall 236 of the tunnel 206 does not have a feature corresponding to the projection 140 of the embodiment of FIG. 4. A portion 250 of the cold air 248 is directed toward the opening 252 and drives cold air 254 through the air passage 238, along the second side 234 of the radiator 228. The cold air 254 contacts the second side 234 of the radiator 228, and absorbs heat from the radiator 228, further cooling the coolant circulating therein. As can be seen, the circulation of cold air 254 is in the same direction as that of the cold air 248.

Figure 7A:
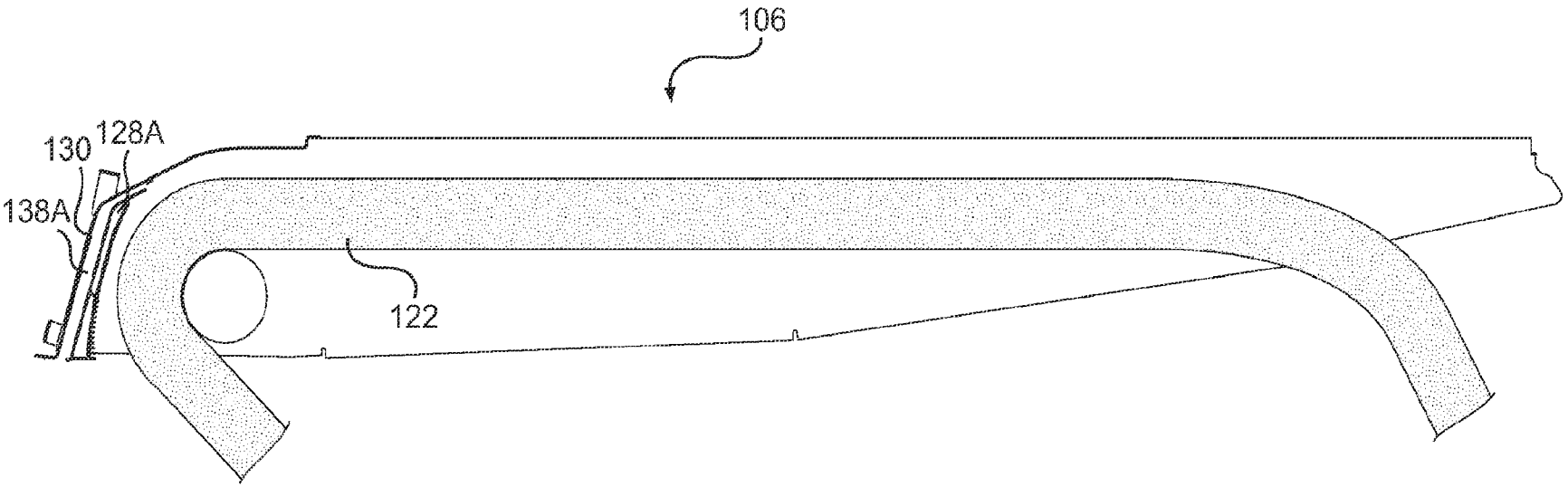
FIGS. 7A-7C are schematic cross-sectional views of snowmobile tunnels, taken along the longitudinal centerline of the tunnel, showing various embodiments of radiator arrangements.
Figure 7B:
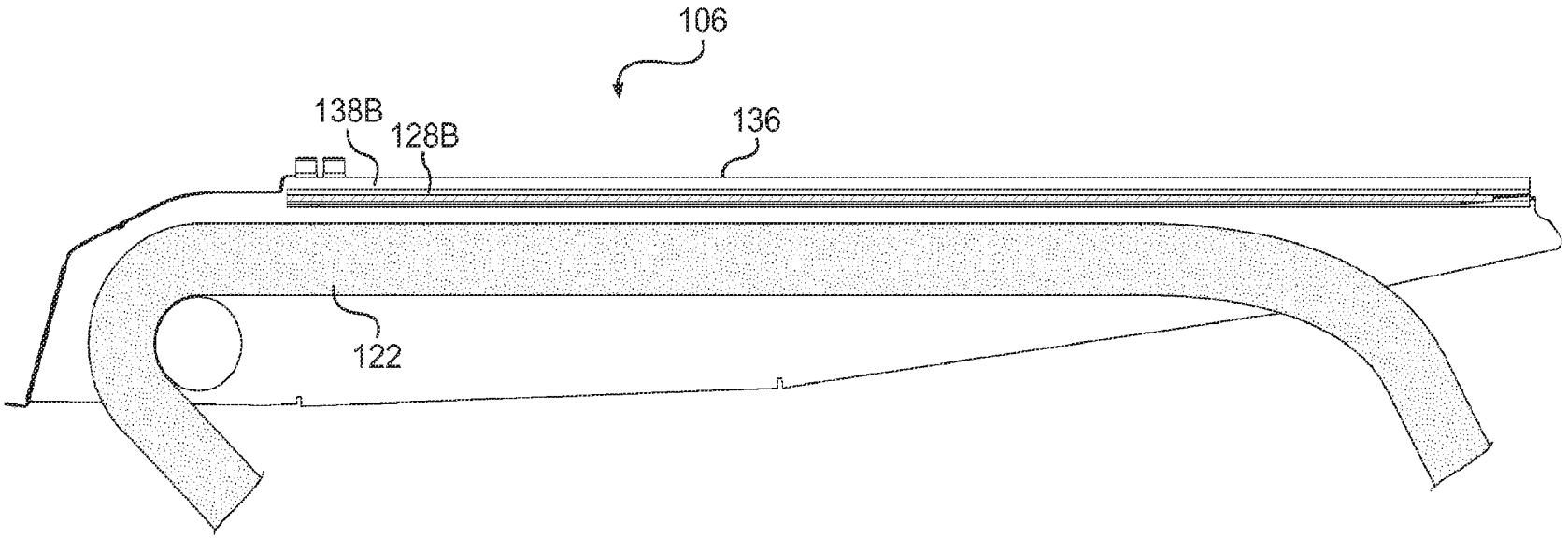
Figure 7C:
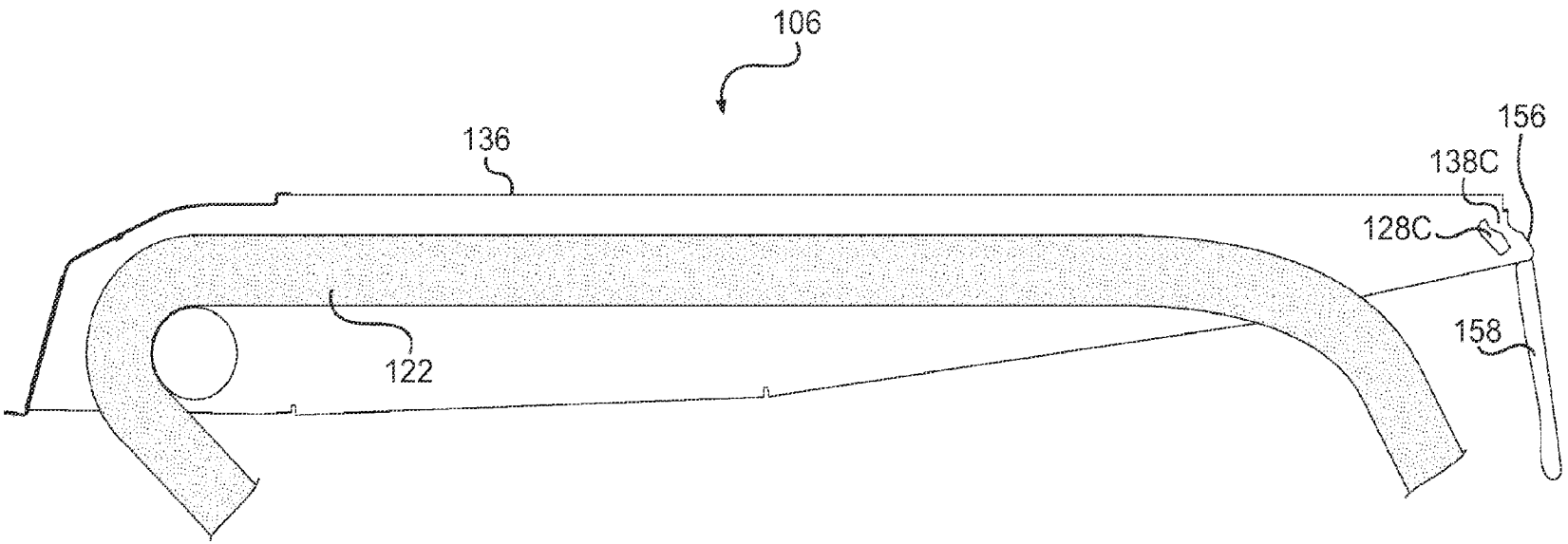

Referring now to FIGS. 7A-7C, a number of possible positions are contemplated for the radiator 128. Referring to FIG. 7A, the radiator 128A is installed in the position shown in FIG. 4, at a forward portion of the tunnel 106, generally forwardly of the track 122. The radiator 128A is spaced apart from the front wall 130, and an air passage 138A is formed therebetween. Referring to FIG. 7B, the radiator 128B is installed along the top wall 136 of the tunnel 106, generally above the track 122. The radiator 128B is spaced apart from the top wall 136, and an air passage 138B is formed therebetween. Referring to FIG. 7C, the radiator 128C is installed at a rearward portion of the tunnel 106, generally rearwardly of the track 122. The radiator 128C is spaced apart from the top wall 136 and the rear wall 156 of the tunnel 106, and an air passage 138C is formed therebetween. A snow flap 158 may be provided rearwardly of the track 122 to increase the circulation of cold air and snow in the vicinity of the radiator 128C.

Referring now to FIGS. 8A-8D, a number of alternative shapes are contemplated for the second side 134 of the radiator 128.

Figure 8A:
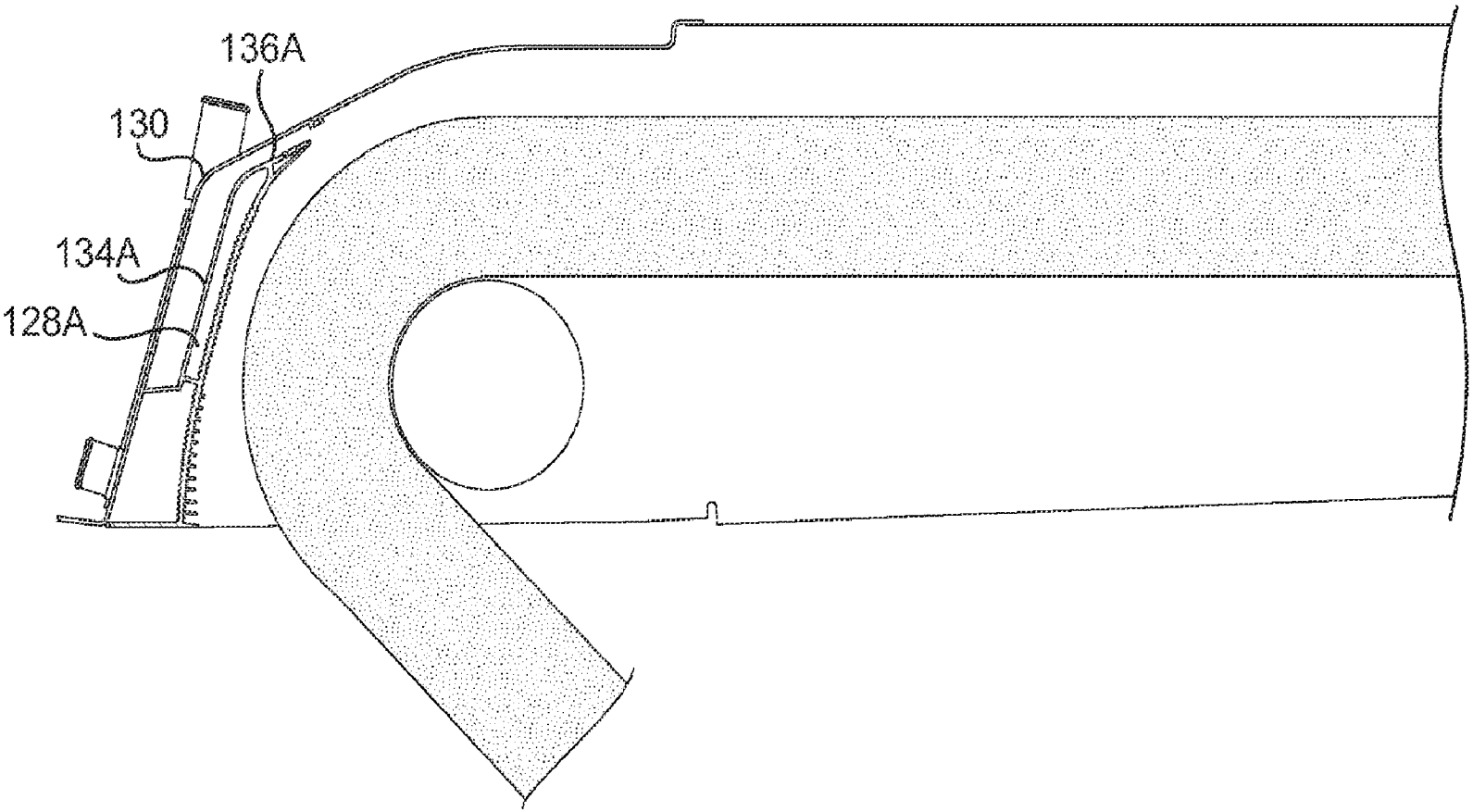
FIGS. 8A-8D illustrate various alternative embodiments of the radiator of the snowmobile of FIG. 3.

Referring to FIG. 8A, a lower portion 135A of the second side 134A of the radiator 128A is in contact with the front wall 130 and an upper portion 136A of the second side 134A is spaced apart from the front wall 130. It is contemplated that the lower portion 135A may comprise 25%, 50% or 75% of the area of the second side 134A, with the upper portion 136A comprising the remainder. It should be understood that the transfer of heat to the tunnel 106 will be reduced to a greater extent if the area of the upper portion 136A is larger relative to the area of the lower portion 135A.

Figure 8B:
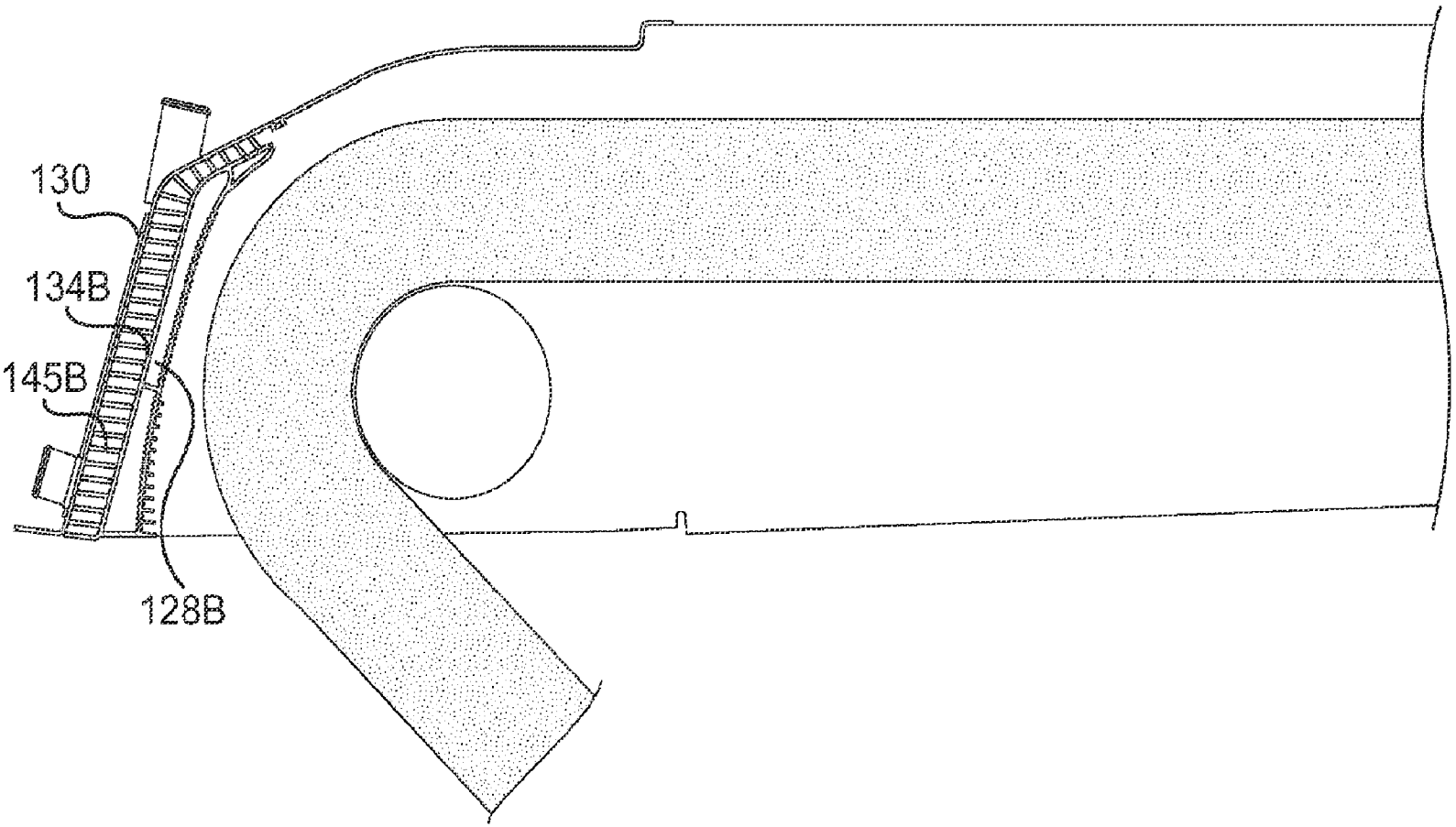

Referring to FIG. 8B, the second side 134B of the radiator 128B is spaced apart from the front wall 130. The fins 145B extend outwardly from the second side 134B and contact the front wall 130. The fins 145B are oriented transversely. In this embodiment, the fins 145B act as spacers between the second side 134B and the front wall 130, and a separate spacer 143 is not needed.

Figure 8C:
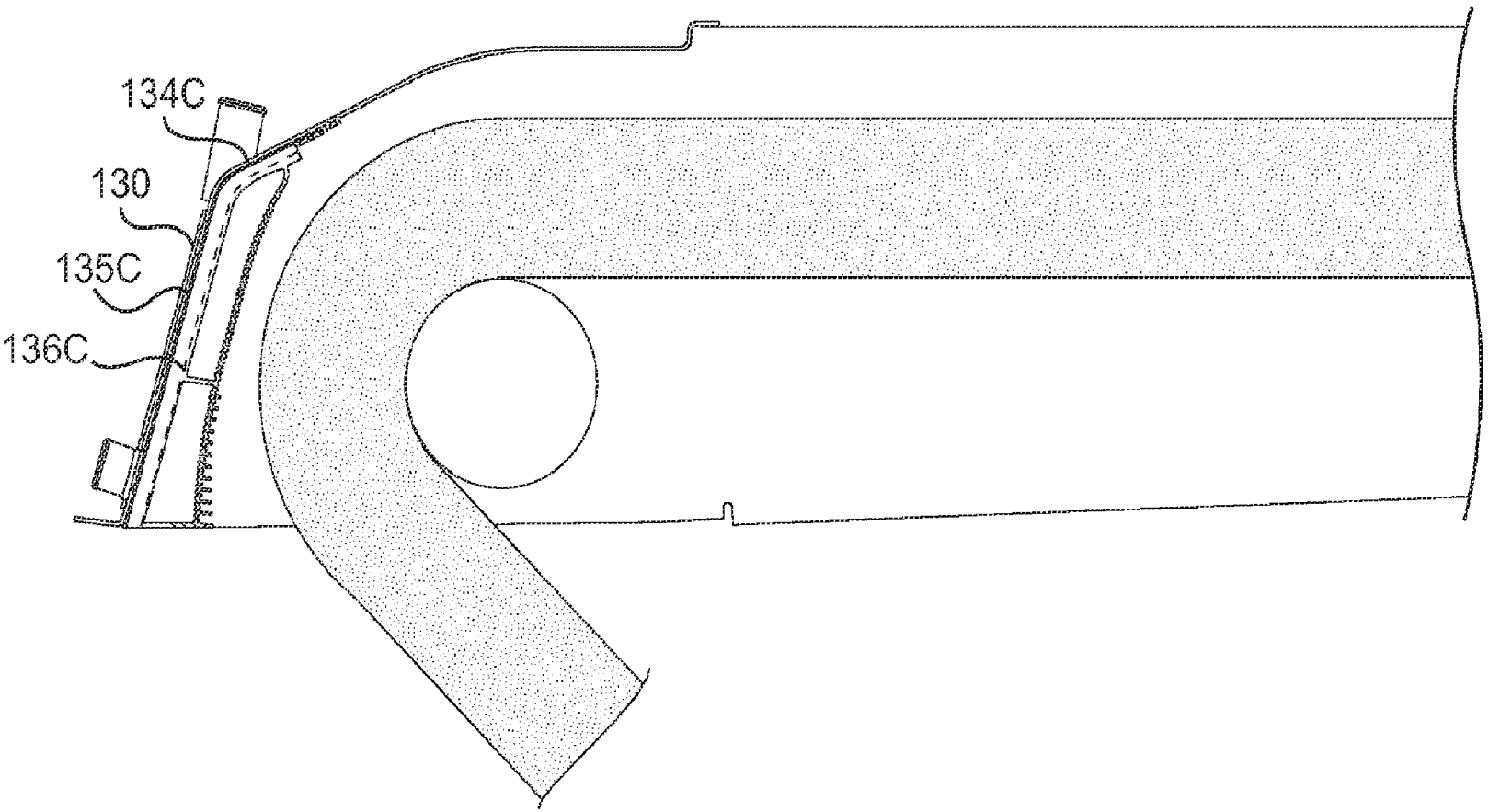
Figure 8D:
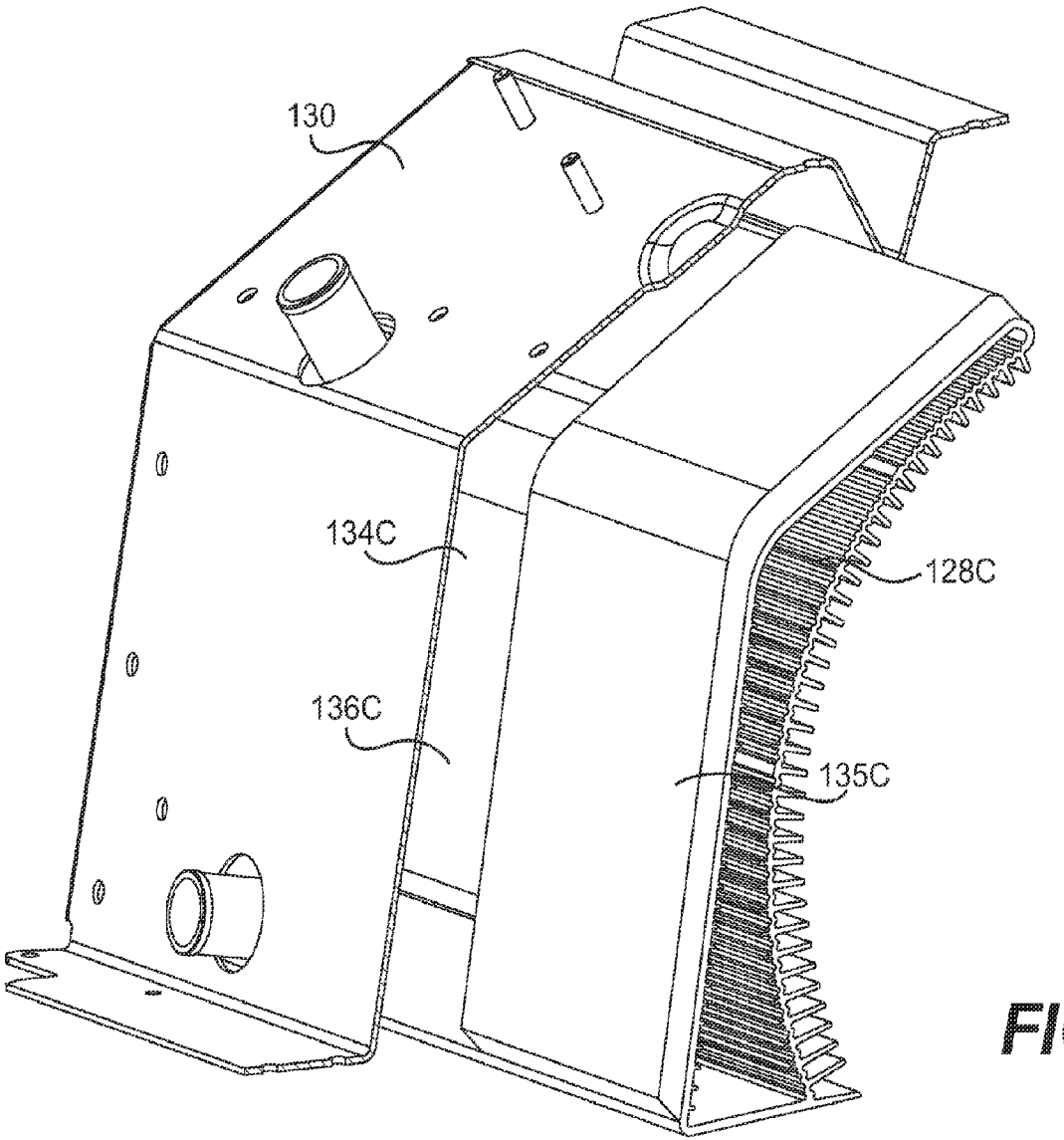

Referring to FIGS. 8C and 8D, the second side 134C of the radiator 128C has two lateral portions. One lateral portion 135C is in contact with the front wall 130 and the other lateral portion 136C is spaced apart from the front wall 130. It is contemplated that the second side 134C may have more than two lateral portions, for example left and right lateral portions 135C in contact with the front wall 130 and a central lateral portion 136C spaced apart from the front wall 130. It is contemplated that the lateral portion 135C may comprise 25%, 50% or 75% of the area of the second side 134C, with the lateral portion 136C comprising the remainder. It should be understood that the transfer of heat to the tunnel 106 will be reduced to a greater extent if the area of the upper portion 136C is larger relative to the area of the lower portion 135C.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A snowmobile comprising:

a frame;

a tunnel formed in a rearward portion of the frame;

an engine disposed on the frame;

a drive track disposed at least in part in the tunnel and being operatively connected to the engine for propulsion of the snowmobile;

at least one ski operatively connected to the frame at least in part forwardly of the drive track;

a straddle seat disposed on the frame at least in part above the drive track;

a steering device operatively connected to the at least one ski for steering the snowmobile;

a radiator disposed between the tunnel and the track, the radiator having a first side facing the track and a second side facing the tunnel, the second side being generally opposite the first side, at least a portion of the second side being spaced apart from the tunnel; and an air passage between the second side of the radiator and the tunnel, when the snowmobile is being operated in a forward direction, a direction of air flow along the first side is opposite a direction of air flow in the air passage.

2. The snowmobile of claim 1, wherein at least 25% of the second side is spaced apart from the tunnel.

3. The snowmobile of claim 1, wherein at least 50% of the second side is spaced apart from the tunnel.

4. The snowmobile of claim 1, wherein at least 75% of the second side is spaced apart from the tunnel.

5. The snowmobile of claim 1, wherein the entire second side is spaced apart from the tunnel.

6. The snowmobile of claim 1, wherein, when the snowmobile is being operated in the forward direction, the direction of air flow in the air passage is a direction of rotation of the track.

7. The snowmobile of claim 1, wherein, when the snowmobile is being operated in the forward direction, the direction of air flow in the air passage is a direction opposite the direction of rotation of the track.

8. The snowmobile of claim 1, wherein the radiator is disposed at least in part forwardly of the track.

9. The snowmobile of claim 8, wherein:

the tunnel has a front wall; and the second side of the radiator faces the front wall of the tunnel.

10. The snowmobile of claim 9, wherein the second side of the radiator generally follows a contour of the front wall of the tunnel.

11. The snowmobile of claim 1, wherein a top wall of the tunnel has a downwardly-extending projection disposed generally rearwardly of the air passage.

12. The snowmobile of claim 11, wherein, when the snowmobile is being operated in the forward direction, an area of reduced air pressure is created at a rearward opening of the air passage.

13. The snowmobile of claim 1, wherein the radiator has an inlet and an outlet, the inlet and the outlet communicating with an interior of the radiator via the second side, the inlet and the outlet passing through the front wall of the tunnel.

14. The snowmobile of claim 1, wherein the first side of the radiator is generally arcuate.

15. The snowmobile of claim 14, wherein:

the track is supported by a plurality of axles, one of the plurality of axles being a forwardmost axle; and the first side of the radiator forms a generally circular arc having a center of curvature approximately at an axis of rotation of the forwardmost axle.

16. The snowmobile of claim 1, wherein:

the first side of the radiator has a plurality of fins projecting outwardly therefrom in a direction of the track; and the second side of the radiator has generally flat sections.

17. The snowmobile of claim 1, wherein:

the first side of the radiator has a first plurality of fins projecting outwardly therefrom in a direction of the track; and the second side of the radiator has a second plurality of fins projecting outwardly therefrom.

18. The snowmobile of claim 17, wherein the second plurality of fins contact the tunnel.

* * * * *